US007786409B2

(12) United States Patent
Hamel et al.

(10) Patent No.: US 7,786,409 B2
(45) Date of Patent: Aug. 31, 2010

(54) IGNITER SHIELDS

(75) Inventors: Scott M. Hamel, Wilton, NH (US); Thomas A. Chodacki, Stow, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 136 days.

(21) Appl. No.: 11/347,675

(22) Filed: Feb. 3, 2006

(65) Prior Publication Data

US 2006/0219691 A1 Oct. 5, 2006

Related U.S. Application Data

(60) Provisional application No. 60/650,337, filed on Feb. 5, 2005.

(51) Int. Cl.
*F23Q 7/22* (2006.01)
*F23Q 7/00* (2006.01)

(52) U.S. Cl. ..... 219/267; 219/260

(58) Field of Classification Search ..... 219/260, 219/261–270

See application file for complete search history.

(56) References Cited

U.S. PATENT DOCUMENTS 3,338,286 A * 8/1967 Hujsak et al. ..... 431/351
3,823,345 A * 7/1974 Mitts et al. ..... 219/267
3,969,656 A * 7/1976 Mitts et al. ..... 361/266
4,029,936 A 6/1977 Schweitzer
4,129,936 A * 12/1978 Takei ..... 438/278
4,905,660 A * 3/1990 Leduc ..... 126/41 R
4,954,743 A 9/1990 Suzuki et al.
5,856,651 A * 1/1999 Shaffer ..... 219/270
5,892,201 A 4/1999 Croucher et al.
6,078,028 A 6/2000 Cooper et al.
6,777,650 B1 * 8/2004 Hamel ..... 219/267
6,933,471 B2 8/2005 Hamel et al.
2006/0011601 A1 1/2006 Hamel et al.

* cited by examiner

*Primary Examiner*—Daniel Robinson
(74) *Attorney, Agent, or Firm*—Edwards Angell Palmer & Dodge LLP; Peter F. Corless; Lisa Swiszcz Hazzard

(57) ABSTRACT

New igniter systems are provided that comprise a ceramic igniter element and an affixed encasing shield element. The shield element may be engaged or affixed to the igniter element in a variety of configurations, including by direct attachment to the igniter element or through another structure interposed between the igniter and shield elements. In preferred systems, a proximal end of an igniter element may be engaged in a mounting structure and a shield element that encases the igniter element is affixed to the mounting structure.

12 Claims, 3 Drawing Sheets

IGNITER SHIELDS

The present application claims the benefit of U.S. provisional application No. 60/650,337, filed Feb. 5, 2005, which is incorporated herein by reference in its entirety.

BACKGROUND OF THE INVENTION

1. Field of the Invention

This invention relates generally to igniters for gaseous fuel, and more particularly to igniters that include igniter elements and shields for protecting the igniter elements.

2. Background

Ceramic materials have enjoyed great success as igniters in e.g. gas-fired furnaces, stoves and clothes dryers. Ceramic igniter production includes constructing an electrical circuit through a ceramic component a portion of which is highly resistive and rises in temperature when electrified by a wire lead. See, for instance, U.S. Pat. Nos. 6,582,629; 6,278,087; 6,028,292; 5,801,361; 5,786,565; 5,405,237; and 5,191,508. See also U.S. Patent Publication 2003/0080193.

Typical igniters have been generally rectangular-shaped elements with a highly resistive "hot zone" at the igniter tip with one or more conductive "cold zones" providing to the hot zone from the opposing igniter end. One currently available igniter, the Mini-Igniter™, available from Norton Igniter Products of Milford, N.H., is designed for 12 volt through 120 volt applications and has a composition comprising aluminum nitride ("AlN"), molybdenum disilicide ("$MoSi_2$"), and silicon carbide ("SiC").

Certain shield elements have been employed for ceramic igniters to provide enhanced mechanical integrity to the igniter system. See U.S. Pat. No. 6,777,650 to Hamel et al., which discloses highly useful igniter/shield systems.

Nevertheless, end-user demands require continued efforts to produce more robust igniter systems with greater manufacturing efficiencies.

It would therefore be desirable to have an igniter including an igniter element and a shield for protecting the igniter element from accidental or other unintended damage or breakage. It would be further desirable to have such an igniter system that is relatively inexpensive to manufactured use.

SUMMARY OF THE INVENTION

New igniter systems are now provided that comprise a ceramic igniter element and an affixed encasing shield element.

The shield element may be affixed to the igniter element in a variety of configurations, including by direct attachment to the igniter element or through another structure interposed between the igniter and shield elements.

A preferred system may further comprise a mounting block or other structure for the ceramic igniter element. In particularly preferred systems, a proximal end of the igniter element may be engaged in the mounting structure and a shield element that encases the igniter element is affixed to the mounting structure. Electrical leads suitably engage the igniter proximal end to provide power to the igniter.

In a preferred system, an igniter system of the invention may comprise a ceramic igniter element that has a proximal portion positioned within mounting structure. A shield element encases the igniter element and is affixed to the mounting structure.

In such igniter systems that include a mounting block interposed between igniter and shield elements of the system, the mounting structure preferably is not metallic and may be formed from e.g. plastic or ceramic materials. An additional mounting bracket which may be of metal construction may be advantageously affixed to such a mounting structure, preferably by peening or press fitting. By not mating the shield element and such a metal mounting bracket, those elements are electrically isolated and thereby potential shock hazards can be avoided.

References herein that a shield element is "secured", "affixed" or "lockingly engaged" (or other similar term) to a ceramic igniter element indicates that the shield element is engaged with the igniter either directly (i.e. directly affixed to igniter element) or indirectly (i.e. affixed to an interposing structure such as a mounting structure) through an affirmative engagement other than simple press fitting. For instance, preferred engagements of shield and igniter elements include mating flanges, mating flange/groove systems, threaded engagement, and the like.

Additionally, in preferred systems, igniter and shield elements are considered "secured", "affixed" or "lockingly engaged" (or other similar terms) where those elements remain mated either directly or through an interposing structure such as a mounting element during normal use of the device and do not e.g. become separated during regular manual handling of the engaged elements. The secured or locked engagement typically does not include direct bonding (e.g. welding) of the shield and igniter or interposed structure elements.

Other aspects of the invention are disclosed infra.

DETAILED DESCRIPTION OF THE INVENTION

As indicated above, the invention provides new shield elements for ceramic igniters. Preferred igniter systems of the invention provide for secure (e.g. lockable) attachment of shield and igniter elements, either directly or indirectly such as through an igniter mounting structure. Particularly preferred igniter systems of the invention also can include effective shield elements with increased manufacturing efficiencies, particularly reduced material(s) of construction.

Particularly preferred igniter system of the invention may comprise (a) a ceramic igniter element having a conductive portion and adapted for igniting gaseous fuel, the conductive portion i) coupled to a resistive hot zone of the igniter and ii) connected to an electrical lead; and (b) a shield element for protecting the igniter element, the igniter element being disposed along the longitudinal axis of the shield element, wherein the shield element comprises a plurality of openings, and the igniter and shield elements are lockingly engaged.

Figure 1:
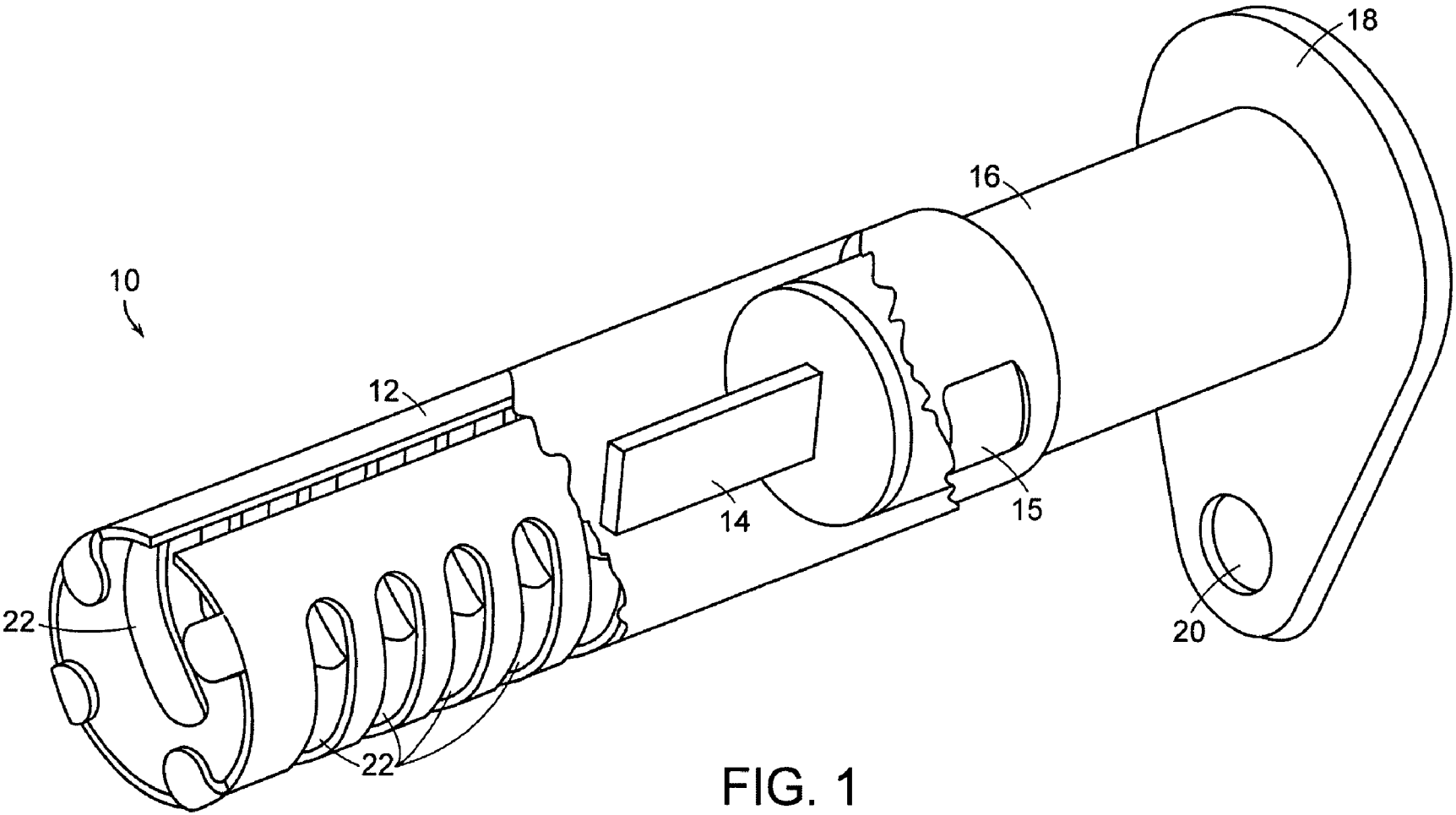
FIG. 1 is a plan view of a preferred igniter of the invention in partial cut-way view.

Referring now to the drawings, FIG. 1 shows a preferred igniter system 10 of the invention which includes shield element 12 in attached engagement with igniter element 14. As depicted, igniter 14 is mounted within igniter mounting structure 16. Such mounting fixture can be formed of any of a variety of materials, including metal, ceramics, plastics and the like. For many applications, it can be preferred to use non-metallic materials of constructions for mounting structure 16 such as a plastic and/or ceramoplastic sealant material to encase the conductive proximal end of the igniter, as generally depicted in FIG. 1. Such use of ceramoplastic materials is disclosed in U.S. Published Patent Application 2003/0080103.

The igniter element 14 suitably may be of any of a variety of configurations, including e.g. ceramic igniter element disclosed in U.S. Pat. Nos. 5,892,201; 6,474,492; and 6,582,629.

In particular, preferred igniter elements 14 typically include conductive end portions coupled to a highly resistive middle portion, which is also known as a "hot zone." In use, conductive end portions of the igniter element can be connected to electrical leads which provide power to the igniter. A portion of the igniter element 14 with connected is then mounted, e.g., cemented using a suitable adhesive, within a ceramic sleeve 16 or other mounting structure, thereby allowing the remaining portion of the igniter element 14*a* to extend from one end of the structure 16. The leads can pass through the length of the mounting structure 16 extend from the opposite end thereof.

As generally depicted in FIG. 1 and discussed above, mounting structure 16 can include additional elements, such as press fit (peened) flange or mounting element 18 which can provide attachment for additional operational elements such as a sensor element (not shown) engaged within aperture 20 and which can detect flame, heat or the like. As discussed above, by separation of metal shield element 12 and metal mounting element 18, potential shock hazards can be avoided.

Shield 12 can be made of any of a variety of suitable materials that can withstand extended exposure to fuel ignition temperatures and can serve to avoid damage or breakage of the encased igniter element 14. Preferred materials of construction of shield elements include those that have sufficient hardness for protecting an encased igniter element from inadvertent damage or breakage, but are also malleable for easily forming the shield and subsequently incorporating the shield into the igniter system. For example, specifically preferred are shields elements made of a high temperature metal alloy, e.g., INCONEL™ (nickel-chromium-iron alloy) or KANTHAL™ metal alloy.

As shown in FIG. 1, shield 12 suitably may have a substantially tubular structure with substantially circular cross-section preferably of similar diameter of the mounting structure 16. Such corresponding diameters of the shield and mounting block elements can enable tight engagement of the elements in addition to affirmative locking mechanisms 15 as may be employed.

It also should be appreciated that in addition to protecting an igniter element from accidental damage or breakage, the shield element also can facilitate mounting of the igniter system in a target industrial or domestic gas burning appliance (not shown).

A shield element suitably comprises one or more preferably a plurality of apertures 22 through which air and fuel gas can flow. The apertures suitably may have a variety of configurations including slits, substantial circles, ovals, diagonally arranged slots, and the like.

Figure 3:
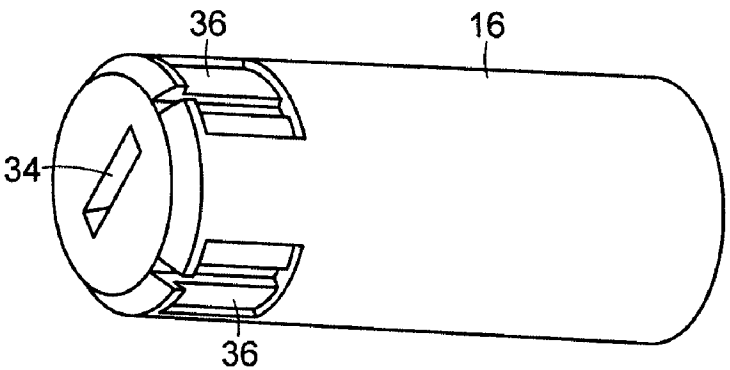
FIG. 3 depicts a preferred igniter mounting block.
Figure 2:
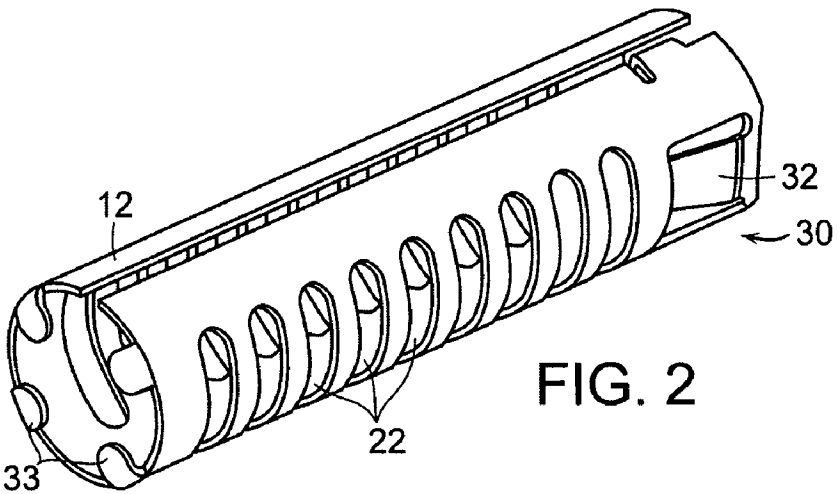
FIG. 2 is a plan view of a preferred igniter shield of the invention.

FIG. 2 shows a preferred shield element 12 of the invention which includes a plurality of slotted apertures 22 and a mating or locking mechanism 30 that includes one or preferably more engagement elements 32 that can attach to igniter mounting block 16 as generally shown in FIG. 3. As depicted in FIG. 3, mounting structure 16 includes igniter aperture 34 which can receive an igniter element and one or more engagement sections 36 that can mate with corresponding flanges 32 of shield 12.

Figure 4:
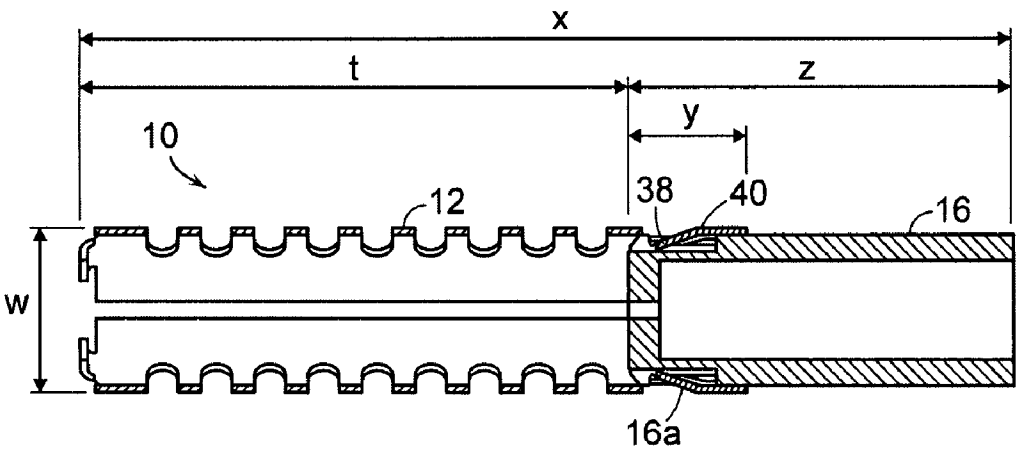
FIG. 4. depicts schematically a preferred igniter system of the invention.

FIG. 4 schematically depicts shield element 12 and mounting structure 16 with respective interlocking shield flange 38 and mounting structure flange 40 that provide engagement of those elements 12 and 16.

As can be seen in FIG. 4, shield element 12 extends only to the proximal end 16*a* of mounting structure 16 thereby minimizing the amount of the shield material of construction. In such preferred systems as exemplified in FIG. 4, a shield element 12 extends no more than about 50 percent of the total length of the igniter mounting structure 16, and more preferably the shield element will extend no more than about 40, 30, 20 or even 10 percent of the total length of the igniter mounting structure 16.

Igniter systems of the invention can be arranged in a variety of configurations and dimensions. Thus, suitable lengths of the a shield/igniter assembly (length x in FIG. 4) can vary widely depending on intended uses of the system. For some preferred systems, length x (as shown in FIG. 4) of the igniter/shield assembly suitably may be 2 to about 12 cm, more preferably about 4 to about 8 cm, with a length x of about 6 cm being particularly suitable. For some preferred systems, the length z (as shown in FIG. 4) of the mounting structure suitably may be 1 to about 6 cm, more preferably about 1.5 to about 5 cm, with a length z of about 2.5 cm being particularly suitable. For some preferred systems, the length t (as shown in FIG. 4) of the shield as extending from the mounting structure suitably may be 1 to about 6 cm, more preferably about 1.5 to about 5 cm, with a length t of about 3.5 cm being particularly suitable. For some preferred systems, the length y (as shown in FIG. 4) of overlap (or mating region) of the shield and mounting structure elements suitably may be 0.25 to about 4 cm, more preferably about 0.25 to about 2 cm, with a length y of about 0.5 cm being particularly suitable. For some preferred systems, the width w (as shown in FIG. 4) of shield and mounting structure elements also can vary and may suitably be 0.25 to about 4 cm, more preferably about 0.25 to about 2 cm, with a width w of about 1 cm being particularly suitable.

Figure 5:
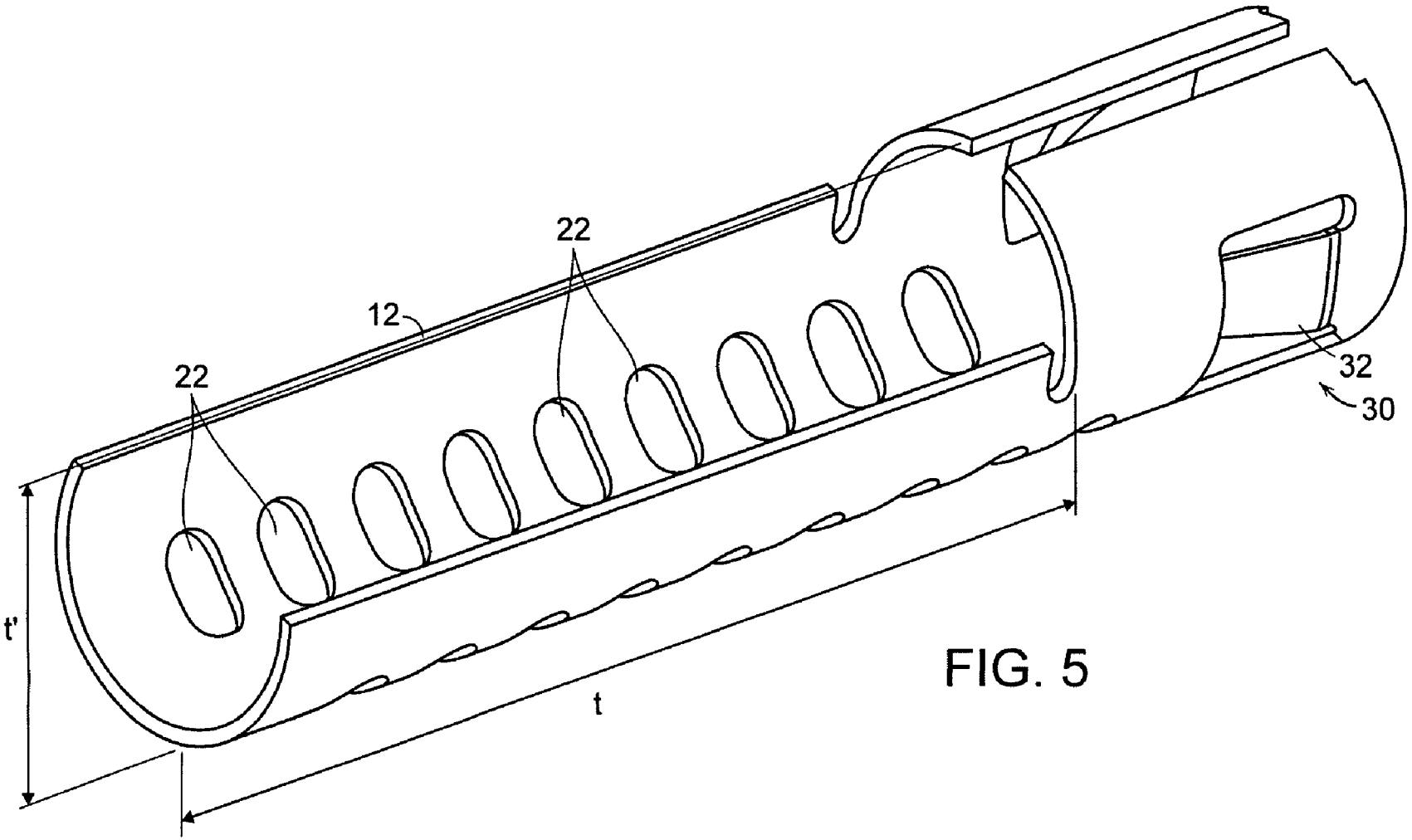
FIG. 5 depicts a further preferred igniter shield of the invention.

FIG. 5 depicts another preferred shield element 12 that comprises a plurality of slotted apertures 22 and a mating or locking mechanism 30 that includes one or preferably more engagement elements 32 that can attach to an igniter mounting block (igniter block not shown in FIG. 5). In the configuration depicted in FIG. 5, igniter region t (that region also shown in FIG. 4) that includes the slotted apertures 22 extends only a portion of the distance to encase an igniter element, whereby a face of the igniter is not shielded. For example, in this configuration the igniter region may suitably extend e.g. only about up to about 80, 70, 60, 50, 40 or 30 percent of an encasing distance t' as that distance t' is illustrated in FIG. 5. Such partially encasing configurations may be advantageous for certain applications, e.g. to permit the shielded igniter element to be positioned more closely to a fuel outlet, such as in a gas cooking grill.

Shield elements can be readily prepared by a variety of methods, including stamping the element from metal sheet stock, which may be the above-mentioned high temperature metal alloy.

The igniters of the present invention may be used in many applications, including gas phase fuel ignition applications such as furnaces and cooking appliances, baseboard heaters, boilers, and stove tops. In particular, an igniter of the invention may be used as an ignition source for stop top gas burners as well as gas furnaces.

Igniters of the invention also may be suitably or use for ignition where liquid fuels (e.g. kerosene, gasoline) are evaporated and ignited, e.g. in vehicle (e.g. car) heaters that provide advance heating of the vehicle.

Additionally, preferred igniter systems of the invention are distinct from heating elements known as glow plugs. Among other things, frequently employed glow plugs often heat to relatively lower temperatures e.g. a maximum temperature of about 800° C., 900° C. or 1000° C. and thereby heat a volume of air rather than provide direct ignition of fuel, whereas preferred igniters of the invention can provide maximum higher temperatures such as at least about 1200° C., 1300° C. or 1400° C. to provide direct ignition of fuel. Preferred igniter systems of the invention also need not include gas-tight sealing around the element or at least a portion thereof to provide a gas combustion chamber, as typically employed with a glow plug system. Still further, many preferred igniters of the invention are useful at relatively high line voltages, e.g. a line voltage in excess of 24 volts, such as 60 volts or more or 120 volts or more including 220, 230 and 240 volts, whereas glow plugs are typically employed only at voltages of from 12 to 24 volts.

All documents mentioned herein are incorporated herein by reference.

The present invention has been described in detail including the preferred embodiments thereof. However, it should be appreciated that those skilled in the art, upon consideration of the present disclosure, may make modifications and/or improvements on this invention and still be within the scope and spirit of this invention as set forth in the following claims.

What is claimed is:

1. An igniter system comprising:

(a) a ceramic igniter element adapted for igniting gaseous fuel;

(b) a shield element for protecting the igniter element, (c) a mounting structure is interposed between the igniter element and shield element; and (d) a mounting bracket affixed to the mounting structure, the mounting bracket being separated from the shield element, the igniter and shield elements being lockingly engaged.

2. The igniter system of claim 1 wherein the shield element overlaps about 50 percent or less of the length of the mounting structure.

3. The igniter system of claim 1 wherein the mounting structure is not of metal construction.

4. The igniter system of claim 1 wherein the shield element is of metal construction.

5. The igniter system of claim 1 wherein the shield element comprises a plurality of openings for the flow of air and fuel.

6. The igniter system of claim 1 wherein the locking engagement of the igniter and shield elements comprises a mating flange and groove system.

7. The igniter system of claim 1 wherein the shield element overlaps about 40 percent or less of the length of the mounting structure.

8. The igniter system of claim 1 wherein the shield element overlaps about 30 percent or less of the length of the mounting structure.

9. The igniter system of claim 1 wherein the shield element overlaps about 20 percent or less of the length of the mounting structure.

10. The igniter system of claim 1 wherein the shield element overlaps about 10 percent or less of the length of the mounting structure.

11. The igniter system of claim 1 wherein a face of the igniter is not shielded.

12. The igniter system of claim 1 wherein the igniter and shield elements are lockingly engaged via mating flanges or threaded engagements.

* * * * *